US005634858A

United States Patent [19]

Bellagamba

[11] Patent Number: 5,634,858

[45] Date of Patent: Jun. 3, 1997

[54] GOLF TRAINING APPARATUS

[76] Inventor: Miro D. Bellagamba, 5161 Vineland Rd., Orlando, Fla. 32811

[21] Appl. No.: 585,157

[22] Filed: Jan. 11, 1996

[51] Int. Cl.[6] ..... A63B 69/36

[52] U.S. Cl. ..... 473/257; 473/267; 473/268; 473/275; 473/277; 473/271; 473/273; 273/DIG. 30; 273/DIG. 17

[58] Field of Search ..... 473/274, 264, 473/267, DIG. 30, 257, 268, 277, 275, 271, 273; 273/DIG. 17

[56] References Cited

U.S. PATENT DOCUMENTS

| | | | |
|---|---|---|---|
| 1,636,753 | 7/1927 | Olcott | 473/274 |
| 3,110,495 | 11/1963 | Carter | 473/267 |
| 4,302,014 | 11/1981 | Shull | 473/264 |
| 4,815,743 | 3/1989 | Meeker et al. | 473/274 X |

*Primary Examiner*—George J. Marlo
*Attorney, Agent, or Firm*—William M. Hobby, III

[57] ABSTRACT

A golf training apparatus includes a head supporting stand having a supporting frame with a base and a vertically extending post which telescopes to different heights extending from the base. A head positioning arm extends from the vertical post. The head positioning arm can be a telescoping member and may have a bendable end pipe member with means for attaching to a person's head. A hook and loop fastener material may be used to removably attach a cap or visor or headband to a person's head. A mirror is supported in a frame adjacent the head support stand and has player positioning markings on the surface thereof. A player swing position guide includes a frame and is positioned a predetermined distance from the head support stand for positioning a golf player's feet and legs for a practice swing in front of the mirror with the head supported by the head support stand head support member. A second mirror may be mounted in a supporting frame and have predetermined surface markings thereon for aligning a golfer for a practice stroke. The head support stand may also have a generally perpendicular extension arm extending from the vertical post for holding an aiming lens in position for the practice golfer to look therethrough at the mirror.

10 Claims, 4 Drawing Sheets

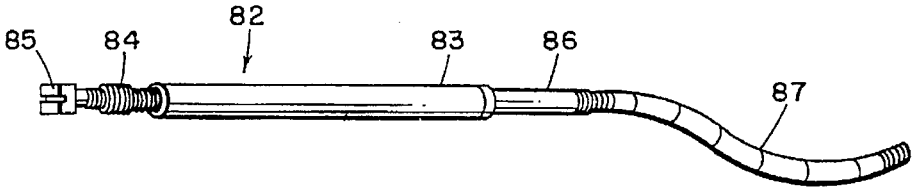
FIG. 4
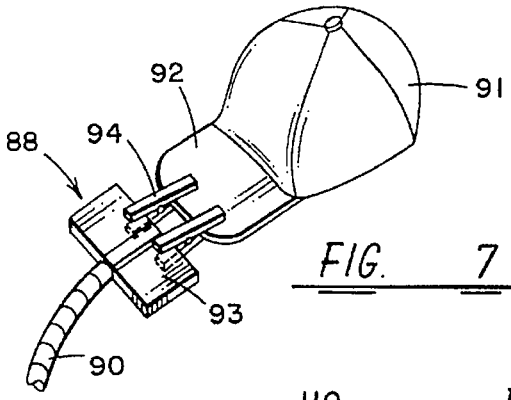
FIG. 7
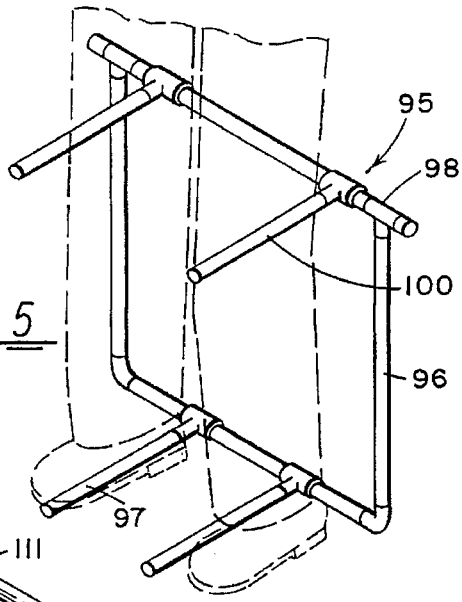
FIG. 5
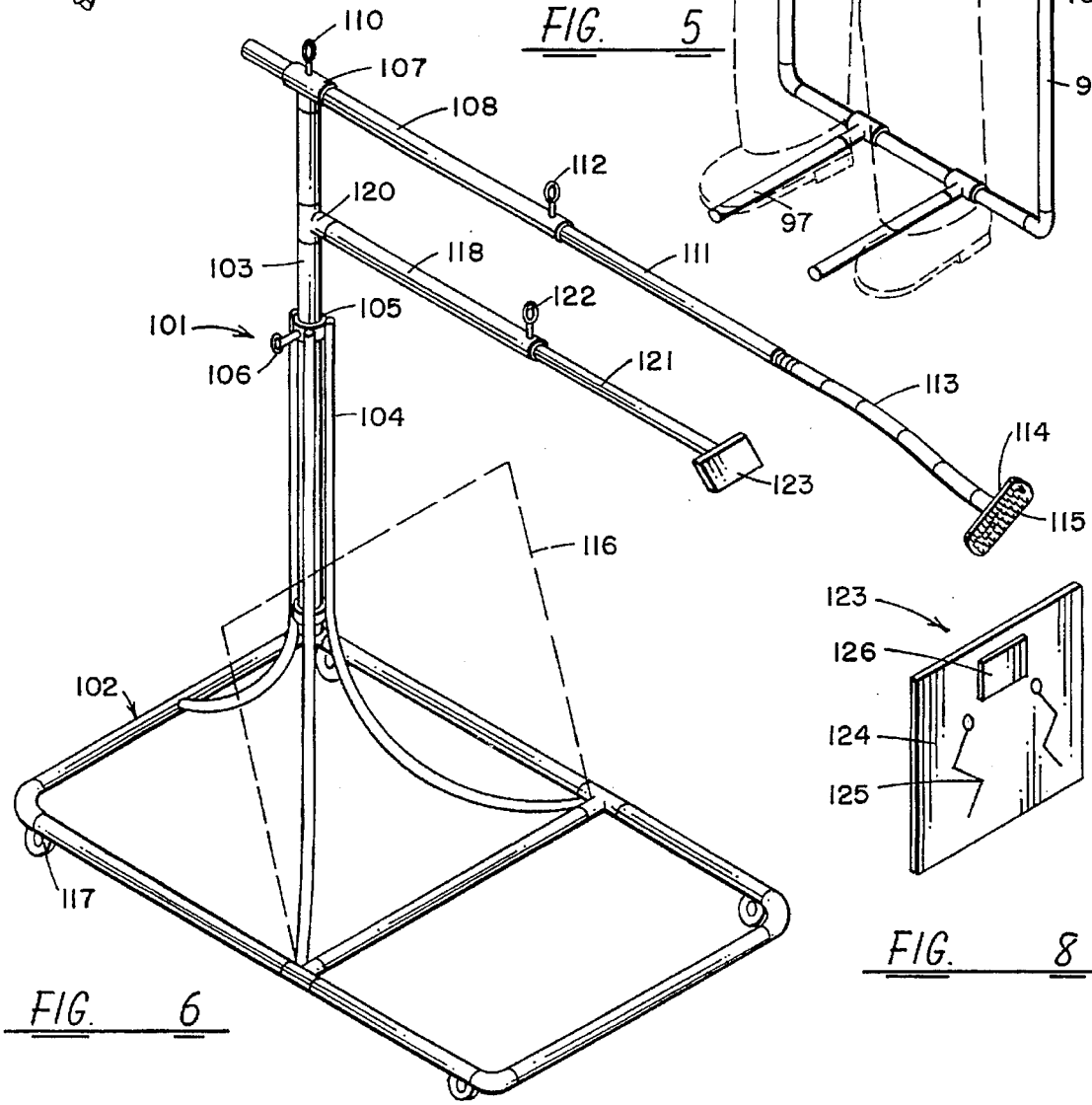
FIG. 6
FIG. 8

GOLF TRAINING APPARATUS

BACKGROUND OF THE INVENTION

The present invention relates to a golf training apparatus and especially to a training apparatus which holds a person's head while positioning the golfer's body in alignment for practice swings.

In the past, it has been common to provide a wide variety of training devices for golfers. Many of these devices are directed towards training a golfer with a golf club swing guide which may include a frame for sliding a golf club upon or, alternatively, may hold a golf club during the swing for directing a golf club in the correct swing pattern. These types of devices may be seen in Applicant's prior U.S. Patents for Golf Training Apparatus U.S. Pat. No. 4,949,974 and U.S. Pat. No. 4,852,881. Another prior U.S. Pat. No. 5,069,456 is for a golf training apparatus having a swing guide which includes multiple telescoping adjustments. Other types of swing practice devices for golfers may be seen in Applicant's prior U.S. Pat. No. 5,048,836 for an Athletic Swing Practice Apparatus which supports the golfer in a lower back support belt with flexible straps and supported between resilient cord members to help control the golfer's stroke. Similarly, prior U.S. Pat. No. 5,024,443, for an Athletic Swing Practice Device is shown in which the golfer's arms are controlled by being strapped together and each supported with a resilient cord to enhance the practice stroke of the golfer. Another prior art golf training device may be seen in the Applicant's prior U.S. Pat. No. 5,026,025 for a Simplified Golf Swing Training Device for guiding the movement of the golf clubs. Design U.S. Pat. No. Des 336,121 shows a golf club swing guide design. In addition to Applicant's prior golf training devices, it has also been suggested to have training devices which position the head of the golfer during the practice swing and as various aligning devices for aligning and levelling club have also been suggested. In addition, there have been various devices for positioning the feet of the golfer in the correct stance for making the proper golf stroke.

The present invention is for an improved golf training system which is readily adjustable for different golfers and which attaches to a golfer's head to hold the head in position while at the same time positioning the feet and legs for the golfer to have the proper stance and includes an adjustable mirror having alignment markings thereon along with an aiming lens for a golfer to be able to view his position in the mirror and the club head and ball at the same time to thereby provide an overall system for multiple alignments of a golfer during making practice swings.

SUMMARY OF THE INVENTION

A golf training apparatus includes a head supporting stand having a supporting frame with a base and a vertically extending post which telescopes to different heights extending from the base. A head positioning arm extends from the vertical post. The head positioning arm can be a telescoping member and may have a bendable end pipe member with means for attaching to a person's head. A hook and loop fastener material may be used to removably attach a cap or visor or headband to a person's head. A mirror is supported in a frame adjacent the head support stand and has player positioning markings on the surface thereof. A player swing position guide includes a frame and is positioned a predetermined distance from the head support stand for positioning a golf player's feet and legs for a practice swing in front of the mirror with the head supported by the head support stand head support member. A second mirror may be mounted in a supporting frame and have predetermined surface markings thereon for aligning a golfer for a practice stroke. The head support stand may also have a generally perpendicular extension arm extending from the vertical post for holding an aiming lens in position for the practice golfer to look therethrough at the mirror.

BRIEF DESCRIPTION OF THE DRAWINGS

Other objects, features, and advantages of the present invention will be apparent from the written description and the drawings in which:

FIG. 4 is an elevation of yet another embodiment of the head supporting extension of the present golf training device;

FIG. 5 is a perspective view of the player's swing position guide for positioning the legs and feet in the present golf training Apparatus;

FIG. 6 is a perspective view an alternate embodiment of the golf training system of FIG. 1;

FIG. 7 is a perspective view of an alternate embodiment of the head attaching member of the present invention;

FIG. 8 is a perspective view of an alignment lens having markings thereon for use in the golf training apparatus;

DESCRIPTION OF THE PREFERRED EMBODIMENT

Figure 1:
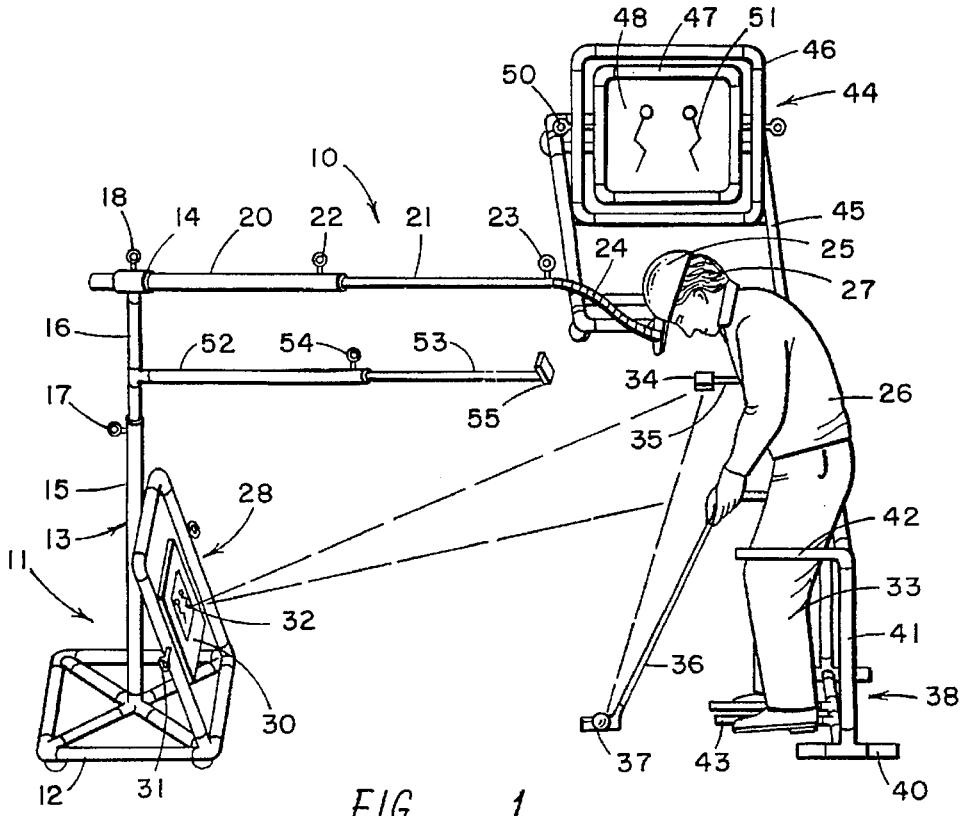
FIG. 1 is a perspective view of a golfer using the golf training apparatus of the present invention.

Referring to the drawings and especially to FIG. 1, a golf training apparatus 10 in accordance with the present invention has a head support stand framework including a base frame 12, a vertically extending and telescoping post 13 having a T-connection 14 on the top thereof. The telescoping post 13 has a cylindrical pipe 15 having a second pipe 16 telescoping therein. An eyebolt 17 is threaded through the PVC pipe 15 to lock the PVC pipe 16 in position to the correct height desired. An eyebolt 18 is threaded through the top of the T-connection 14 for locking a head supporting arm 20. The arm 20 slides within the sleeve of a T-connection 14 and has a second telescoping arm member 21 telescoping inside the arm 20. An eyebolt 22 is threaded through the pipe 20 for locking the telescoping arm 21 in place. An eyebolt 23 is threaded through the arm 21 at the end thereof and locks a bendable arm 24 to the end of the arm member 21. Bendable arm 24 can be bent in any direction desired and will hold itself in place once it is positioned. Bendable arm 24 of FIG. 1 has a visored cap 25 attached thereto which may be placed on a golfer 26 head 27 for holding the head in place after the telescoping arm 20 has been positioned and the height has been adjusted with the telescoping post 13 and the bendable arm 24 has been positioned. This then holds the golfer's head 27 in the proper position.

The base frame portion 12 can be seen having a mirror mounting frame portion 28 attached thereto supporting a mirror 30 with adjustable bolts 31 which allow the mirror to be tilted as desired even though the frame 28 has already been slanted. The mirror 30 has leg positioning markings 32 thereon so that the golfer 26 can align his legs 33 therewith by looking through an aiming lens 34 attached to a lens arm 35 attached to the golfer 26. The golfer is holding a club 36 adjacent a golf ball 37. The golfer is standing in a player swing position guide frame 38 having supporting feet 40, upright members 41 and leg positioning arms 42. There is also a pair of adjustable feet aligning members 43. The present embodiment may also have a second framed mirror 44 having a supporting base 45 with a frame supporting portion 46 and a mirror holding frame 47 having a mirror 48 mounted therein. The mirror frame 47 is supported by eyebolts 50 which allow the mirror to be tilted as desired while the mirror has guide markings 51 on the surface thereof to allow the golfer to align his legs as desired.

In operation, a golfer would have the head supporting stand frame 11 adjusted for height with a telescoping post 13 and the head supporting arms 20 and 21 extended for the golfer's position and the bendable arm 24 bent to adjust for the golfer's head position. The golfer wearing the cap 25 is held in position while the framework 38 aligns both his feet and his legs in position for making a swing. The golfer can then look through the aiming lens 34 views the mirror 30 with the aligning markings 32 and with markings that may be on the lens 34 to hold the golfer in the correct position for the practice swing. The apparatus of FIG. 1 also has an extendable lens arm 52 attached to the vertical post 16 which has a telescoping arm 53 telescoping in the member 52 and which is locked in place with the eyebolt 54. This extendable arm has the lens 55 attached thereto at an angle and may be adjusted for use by the golfer 26 in lieu of the lens 34 supported directly on the body. The lens 55 may be adjusted in position for the golfer for aligning the golf club and the golfer's body for the practice swing.

Figure 2:
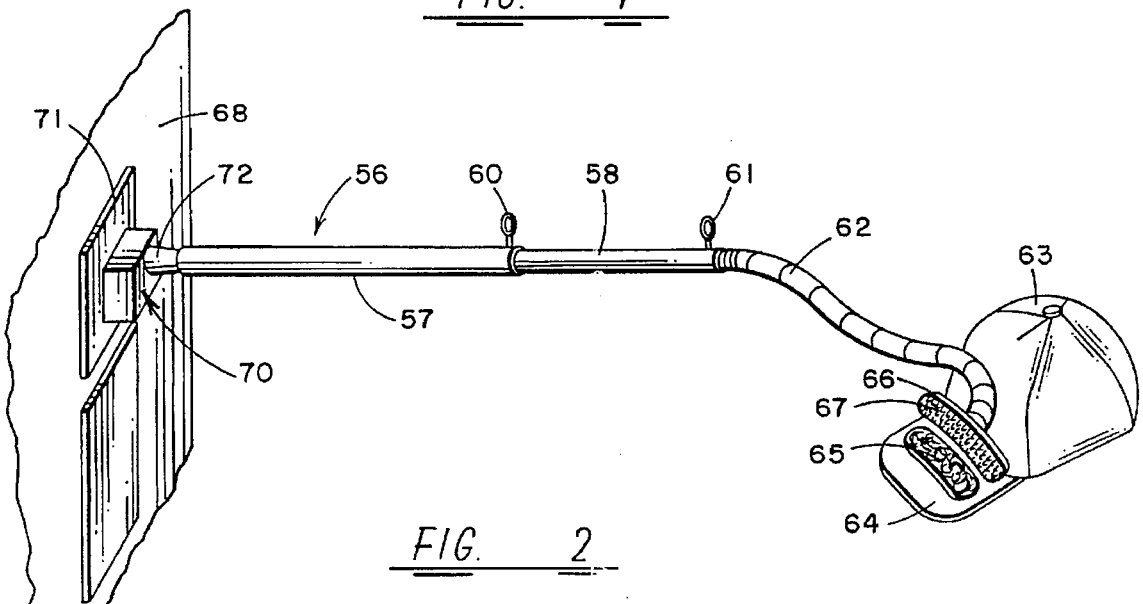
FIG. 2 is a perspective view of an alternate embodiment of the head positioning apparatus.
Figure 3:
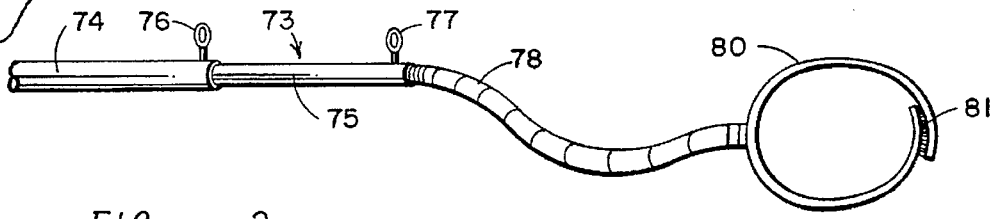
FIG. 3 is a perspective view of yet another head positioning Apparatus in accordance with the present invention.

Turning to FIG. 2, an alternate embodiment of the golfer's head supporting arm 56 is illustrated having a telescoping arm 57 having a telescoping arm 58 telescoping into the arm 57 and lockable in place with the eyebolt 60. The eyebolt 61 attaches the bendable arm 62 thereto which can be bent and adjusted to position a golfer's head in the exact position needed for the golf swing. A visored cap 63 has a visor 64 thereon and a portion of hook and loop material 65 attach thereto while the bendable arms 62 has a head attaching member 66 having the other portion of the hook and loop material 67 thereon for quickly connecting with a hook and loop material 65 on the visor 64 so that an individual's cap can be changed for different individuals. The supporting arm 57, in this case, is mounted directly to a wall surface 68 with a supporting bracket 70 having a base 71 attached to the wall 68 and a cylindrical pipe supporting member 72 extending therefrom for supporting the arm 57. FIG. 3 shows a modified embodiment of the head supporting arm 73 having a first head supporting arm 74 and a telescoping arm 75 telescoping in the cylindrical arm 74 and lockable in place with the eyebolt 76. The eyebolt 77 holds the bendable arm 78 which has a headband 80 attached thereto with hook and loop material 81 for sizing the band 80 to an individual's head so that different golfers can use the same band 80 for locking the head in position with the head locking arm 73.

FIG. 4 shows yet another embodiment 82 of the head locking arm having a tubular arm 83 supported with a spring or shock absorbing end 84 and having a wall mounting fastener 85 on the end of the spring In addition, a tubular arm 86 can be a telescoping arm and have the bendable arm 87 attached thereto which can then have a fastener desired on the end thereof.

FIG. 7 shows yet another fastener 88 for the end of a bendable arm 90 for attaching to a visored cap 91 having a visor 92. The embodiment in FIG. 7 has a plate 93 having clips 94, such as clothesline clips, attached thereto which may be quickly snapped onto a visor 92 to hold the head in place.

FIG. 5 more clearly shows the player swing position guide 95 in an alternate embodiment from that shown in FIG. 1 and having the vertical members 96 along with the foot aligning members 97, top frame member 98, and the leg positioning members 100. The leg positioning members 100 and feet positioning members 97 can be adjusted by sliding on T-mounts along the top and bottom frame bars.

Referring to FIG. 6, another embodiment 101 of the basic golf training apparatus is illustrated having the base frame 102 and the vertically extending post 103 having a plurality of support arms 104 for supporting the vertically extending post 103. The arm 104 have a pair of rings 105 attached thereto with eyebolts for locking the vertically extending post 103 thereto in different positions for different golfers. The vertical extending post 103 has a T-connector 107 mounted on the top thereof having an arm 108 sliding therein and locked in place with an eyebolt 110. Telescoping arm 111 telescopes within the bar 108 and is locked in place with the eyebolt 112. A bendable and positionable arm 113 is mounted on the end of the telescoping arm 111 and has an end member 114 thereon having hook and loop material 115 mounted thereover for attaching to hook and loop material on a visor or visored cap or the like for holding a golfer's head in position. This embodiment shows a mirror 116 positioned in phantom and supported on the frame base 102. The frame base may have wheels 117. In addition, a second arm 118 is attached through a T-connection 120 to the vertical post 103 and has a telescoping arm 121 telescoping in the member 118 and locked in place with the eyebolt 122. An alignment is mounted on the end of the post 121 similar to that shown in FIG. 1. The alignment lens may be seen in FIG. 8, having a flat lens surface 124 along with predetermined leg guide marking members 125 etched or coated onto the surface 124. In addition, an alignment lens 126 may be attached thereto for assisting and in the alignment of the golfer's head along with holding his legs in the framework 95 as viewed through the mirror 116.

Figure 9:
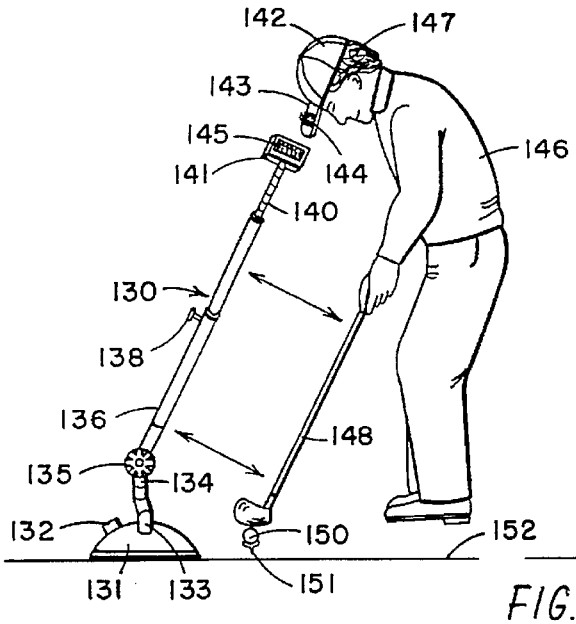
FIG. 9 is a side elevation of another embodiment of the head positioning apparatus.
Figure 10:
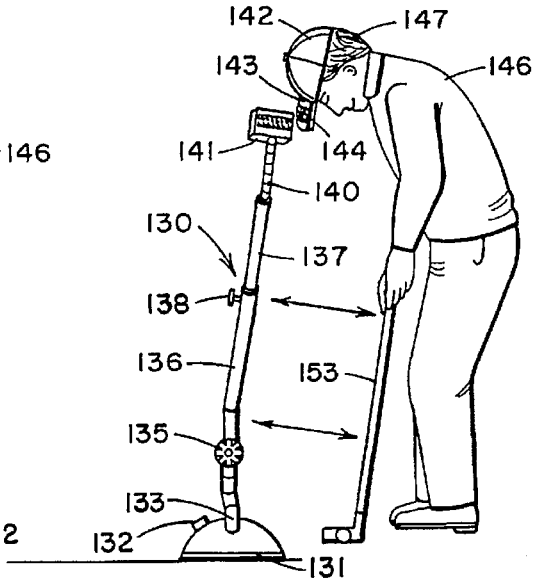
FIG. 10 is a side elevation of the embodiment of FIG. 9 positioned for a different golf club.
Figure 11:
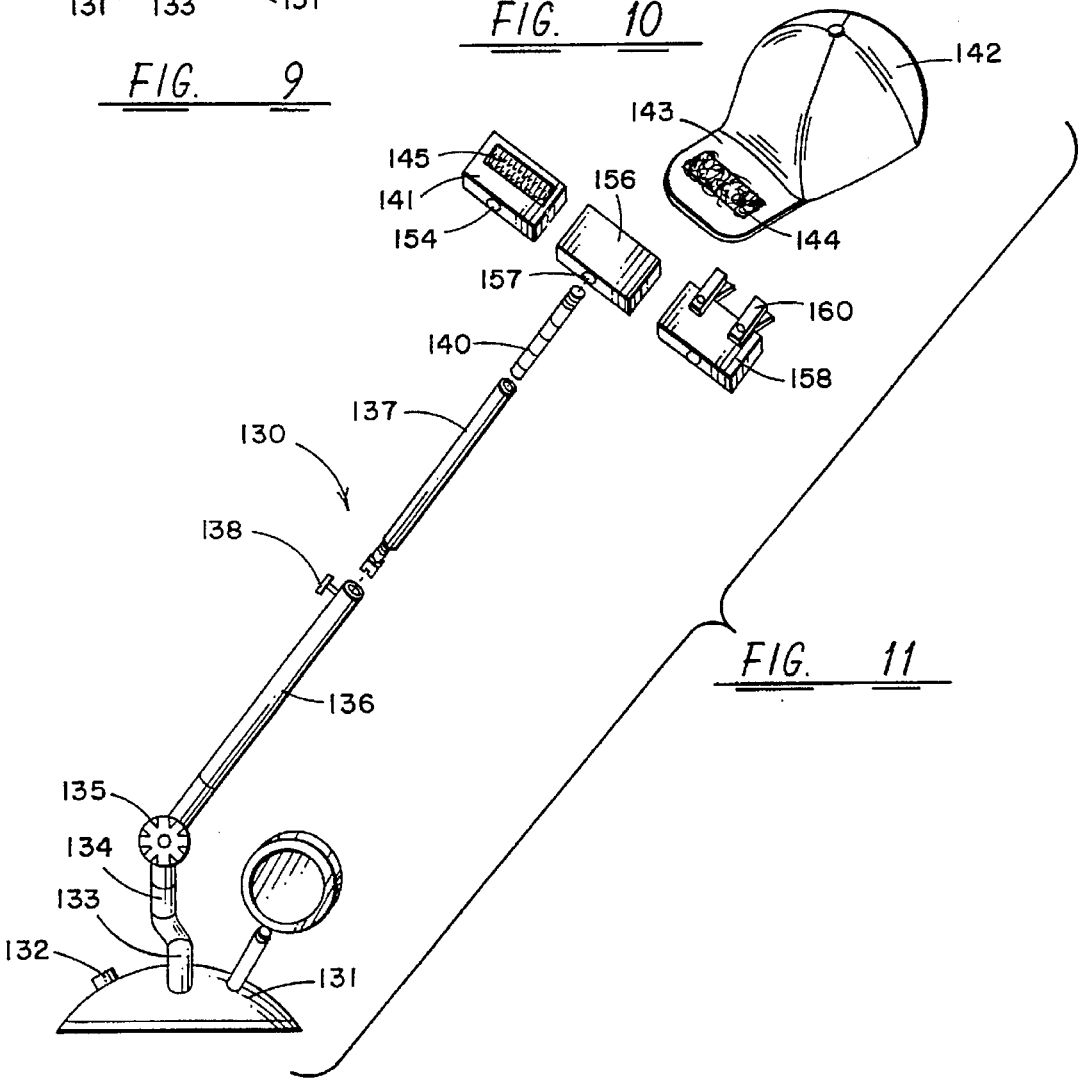
FIG. 11 is an exploded view of the embodiment of FIGS. 9 and 10.

Turning to FIGS. 9–11, another embodiment of the golf training apparatus head supporting and positioning stand 130 is illustrated which includes a base 131 with an opening 132 so that the base can be filled with sand to give it added weight for support. A protruding support pipe 133 extends from the base and has an inserted pipe 134 inserted thereinto. Pipe 134 has an adjustable ratcheting joint 135 which can be adjusted for any desired angle of the tube 136 extending therefrom. Tube 136 has a telescoping tube 137 extending thereinto with a threaded locking fastener 138 for locking the telescoping tube 137 in any desired position. A stiff flexible tube 140 extends from the end of the tube 137 for final adjustment to a person's head position. Flexible tube 140 has an end attaching member 141 attached thereto for attaching a golfer's cap 142. A golfer's cap, as illustrated, has a visor 143 and a strip of hook and loop material 144 attached thereto. Attaching member 141 has a strip of VELCRO hook and loop material 145 attached thereto for attaching to the VELCRO 144 on the visor 143 of the cap 142. A golfer 146 is shown with his head 147 in the cap 142 and holding a golf club 148 in front of a golf ball 150 on a tee 151 sitting on the earth 152. The head supporting stand 130 has been positioned at an angle which is parallel to the angle of the shaft 148 and the head is held in the position as shown.

In FIG. 10, the head positioning stand 130 has been repositioned for the same golfer 146 but who is now holding a putter 152 which positions the golfer 146 closer to the shaft of the putter 152 and changes the angle of the extending head support members 136 and 137 and telescoping member 137 has been telescoped into member 136. The angle position has been adjusted with the adjustable ratchet 135. This allows the repositioning of the head for using a shorter club or putter while keeping the angle of the putter 152 parallel to the pipe member 136.

The exploded view of a head positioning stand 130, in FIG. 11, has the base 131 on the earth (or floor) 152 with the upright pipe 133 connected to the pipe 134 attached to the adjustable ratchet joint 135 supporting the pipe 136 and the telescoping pipe 137 locked in place with the threaded fastener 138. The flexible rigid metal tube member 140 has the attaching head 141 threaded thereon with internal threads 154 threaded onto the threads 155 of the flex tube 140 with the VELCRO 145 attached thereto. Other attaching tips 156 also have a threaded opening thereinto but without the hook and loop material 145. Another end member 158 has the plastic clips 160 thereon for attaching to the visor 143 of the golf cap 142. Since the golf cap 142 has the hook and loop material 144 already attached thereto, it can be connected to the flexible tube 140 with either the hook and loop material 145 of the end member 141 or the clips 160 of the end member 158.

The embodiments shown in FIGS. 9, 10 and 11 is for positioning a golfer's head in a golf head trainer and is both inexpensive and has the advantage of slanting the telescoping pipe 138 and 137 to allow the adjustment of the angle from the ground to the golfer's cap such as to be parallel or at the same angle as the shaft of the golf club during practice swings while simultaneously holding the head in the proper position for using different clubs and maintaining the proper address of the ball to the golfer's hand.

Figure 12:
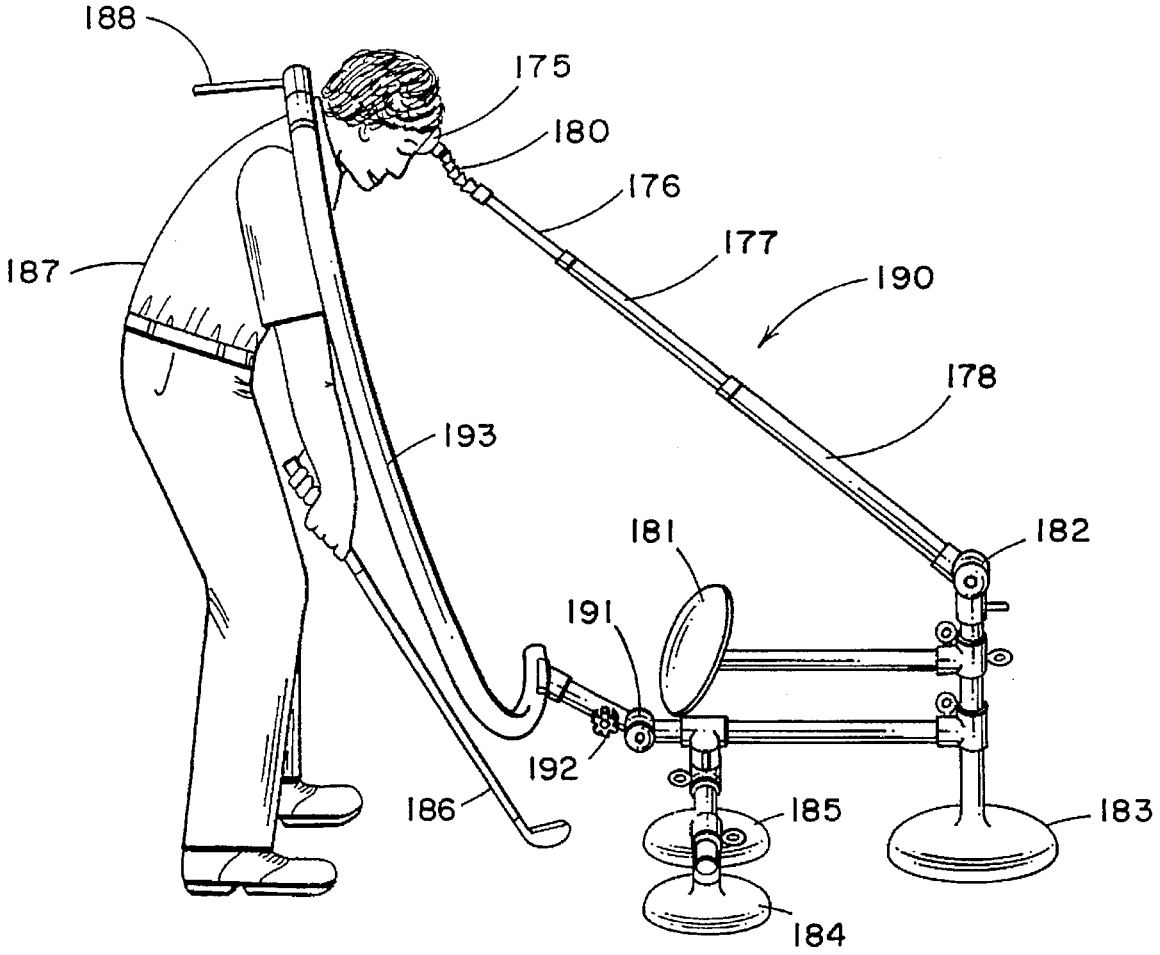
FIG. 12 is a perspective view of a golfer using another embodiment of the golf training apparatus of the present invention.

FIG. 12 is yet another embodiment of a golf training apparatus 190 for positioning the head of a golfer 187 while controlling a practice swing with the golf club 186. The golfer's swing is guided by the PVC swing guide 193 which in turn is supported from an adjustable hinge 191 which can be locked in place with the threaded lock 192. The swing guide 193 is supported with a pair of base plates 184 and 185 and is further supported with a base plate 183 having a vertical arm which includes an extension arm holding a mirror 181 which can be positioned for the golfer to view his stroke and the movements of his body as he performs a practice swing guided on the guide 193. The top of the vertical post extending from the base 183 has a hinge 182 adjustably supporting a telescoping arm 178 having telescoping members 177 and 176 extending therefrom. The telescoping member 176 has a bendable, positionable arm 180 on the end thereof for adjusting a head supporting cup 175. Thus, the golfer can telescope the arms 176 and 177 to a desired position and adjust the bendable arm to align the cup 175 to fit onto the forehead to hold his head in position while he performs a practice swing with the club 186 along the golf swing guide 193. The practice stroke and movement of the body can be viewed through the mirror 181 simultaneously with making the swing with the club 186 along the swing guide 193. A body positioning guide 188 acts as a corner and can be rotated on the end of the swing guide 193 for aligning the head or the body for making practice swings. Thus, a user can align the guide 188, adjust the position of the head cup 175, then support his head on the cup 175 while he practices golf swings with the club 186 on the swing guide 193 while viewing the stroke in the mirror 181. This embodiment generally simplifies the prior embodiment of the present invention.

It should be clear at this time that an object of the present invention is to position the golfer's body including the head, feet, and legs during practice swings of a golfer. However, the present invention should not be construed as limited to the forms shown which are to be considered illustrative rather than restrictive.

I claim:

1. A golf training apparatus comprising:

a base;

a vertically extending post attached to said base;

a lockable joint attached to said vertically extending post;

a telescoping pipe member attached to and extending from said lockable joint;

an adjustable head positioning arm attached to the end of said telescoping pipe member; and a head attaching member attached to the end of said adjustable head positioning arm and removably attachable to a golfer's head; whereby a golfer's head can be held in a desired position for a practice golf swing with said player's head attaching member positioned by adjusting said lockable joint for a predetermined angle of said telescoping pipe member and telescoping said telescoping pipe member for a predetermined distance and adjusting said adjustable head positioning member; and a mirror arm attached to said vertical extending post and having a mirror attached to the end thereof positionable for a golfer to view thereinto when his head is held in said head attaching member.

2. A golf training apparatus in accordance with claim 1 in which said base member includes a hollow base container filled with a fluid weighting material and having a cappable opening thereinto.

3. A golf training apparatus in accordance with claim 1 in which said adjustable head positioning arm has a bendable arm portion for aligning the player head attaching member with a play's head.

4. A golf training apparatus in accordance with claim 1 in which said player head attaching member includes a visored cap.

5. A golf training apparatus in accordance with claim 4 in which said player head attaching member visored cap is removably attached to said adjustable arm with hook and loop fastener material.

6. A golf training apparatus in accordance with claim 1 in which said adjustable head positioning arm has a head support cushioned cap on the end thereof.

7. A golf training apparatus in accordance with claim 1 including an outrigger arm extending from said vertically extending post and having an outrigger base attached thereto.

8. A golf training apparatus in accordance with claim 7 including a curved golf club swing guide attached to said outrigger arm and positioned to guide a golfer's club shaft for making practice swings.

9. A golf training apparatus in accordance with claim 8 in which said golf club swing guide has a body positioned guide adjustably attached thereof.

10. A golf training apparatus in accordance with claim 8 in which said outrigger arm has a lockable joint therein for adjusting the positioning of said golf club swing guide for a golfer.

* * * * *